US010437175B2

(12) United States Patent
Horiguchi et al.

(10) Patent No.: US 10,437,175 B2
(45) Date of Patent: Oct. 8, 2019

(54) IMAGE FORMING APPARATUS AND METHOD USING UV LIGHT AND TONER WITH UV ABSORBER

(71) Applicant: Konica Minolta, Inc., Tokyo (JP)

(72) Inventors: Haruo Horiguchi, Koganei (JP); Seijiro Takahashi, Kokubunji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/028,070

(22) Filed: Jul. 5, 2018

(65) Prior Publication Data

US 2019/0011857 A1 Jan. 10, 2019

(30) Foreign Application Priority Data

Jul. 10, 2017 (JP) ..... 2017-134687

(51) Int. Cl.

| | |
|---|---|
| ***G03G 15/16*** | (2006.01) |
| ***G03G 9/087*** | (2006.01) |
| ***G03G 15/10*** | (2006.01) |
| ***G03G 15/20*** | (2006.01) |
| ***G03G 9/13*** | (2006.01) |
| ***G03G 9/08*** | (2006.01) |
| ***G03G 9/09*** | (2006.01) |

(52) U.S. Cl.

CPC ..... *G03G 15/16* (2013.01); *G03G 9/0821* (2013.01); *G03G 9/08753* (2013.01); *G03G 9/09* (2013.01); *G03G 9/0926* (2013.01); *G03G 9/13* (2013.01); *G03G 15/105* (2013.01); *G03G 15/2064* (2013.01)

(58) Field of Classification Search

CPC .. G03G 15/16; G03G 15/105; G03G 15/2064; G03G 9/08753; G03G 9/13

See application file for complete search history.

(56) References Cited

U.S. PATENT DOCUMENTS

| | | | | |
|---|---|---|---|---|
| 2002/0106227 | A1 | 8/2002 | Rohde et al. | |
| 2007/0207402 | A1 * | 9/2007 | Takagi | G03G 9/08793 430/110.2 |
| 2008/0032225 | A1 * | 2/2008 | Teshima | G03G 9/12 430/114 |

(Continued)

FOREIGN PATENT DOCUMENTS

| | | | |
|---|---|---|---|
| JP | H11-38667 | A | 2/1999 |
| JP | 3030437 | B2 | 4/2000 |
| JP | 2007-140177 | A | 6/2007 |

OTHER PUBLICATIONS

Extended European Search Report dated Oct. 11, 2018 from corresponding European Application No. 18182441.8.

*Primary Examiner* — David J Bolduc

(74) *Attorney, Agent, or Firm* — Lucas & Mercanti, LLP

(57) ABSTRACT

An image forming method uses a toner including toner particles including a binder resin and an ultraviolet light absorber. Content of the ultraviolet light absorber is within a range of 0.1 to 50 mass % with respect to total mass of the toner particles. The method includes: transferring a toner image formed with the toner on a recording medium; and irradiating the toner image transferred on the recording medium with monochromatic light having a maximum emission wavelength within a wavelength range of 280 to 550 nm to melt and fix the toner image.

9 Claims, 1 Drawing Sheet

(56) References Cited

U.S. PATENT DOCUMENTS

| | | | | |
|---|---|---|---|---|
| 2009/0104556 | A1* | 4/2009 | Grierson | C09D 5/035 430/108.23 |
| 2010/0055602 | A1* | 3/2010 | Teshima | G03G 9/08755 430/114 |
| 2011/0020030 | A1* | 1/2011 | Mera | G03G 9/0812 399/111 |
| 2011/0236821 | A1 | 9/2011 | Kageyama | |
| 2015/0093700 | A1* | 4/2015 | Momotani | G03G 9/131 430/114 |
| 2016/0011537 | A1* | 1/2016 | Higuchi | G03G 15/04045 399/177 |
| 2018/0217518 | A1* | 8/2018 | Takahashi | C09B 29/34 |

* cited by examiner

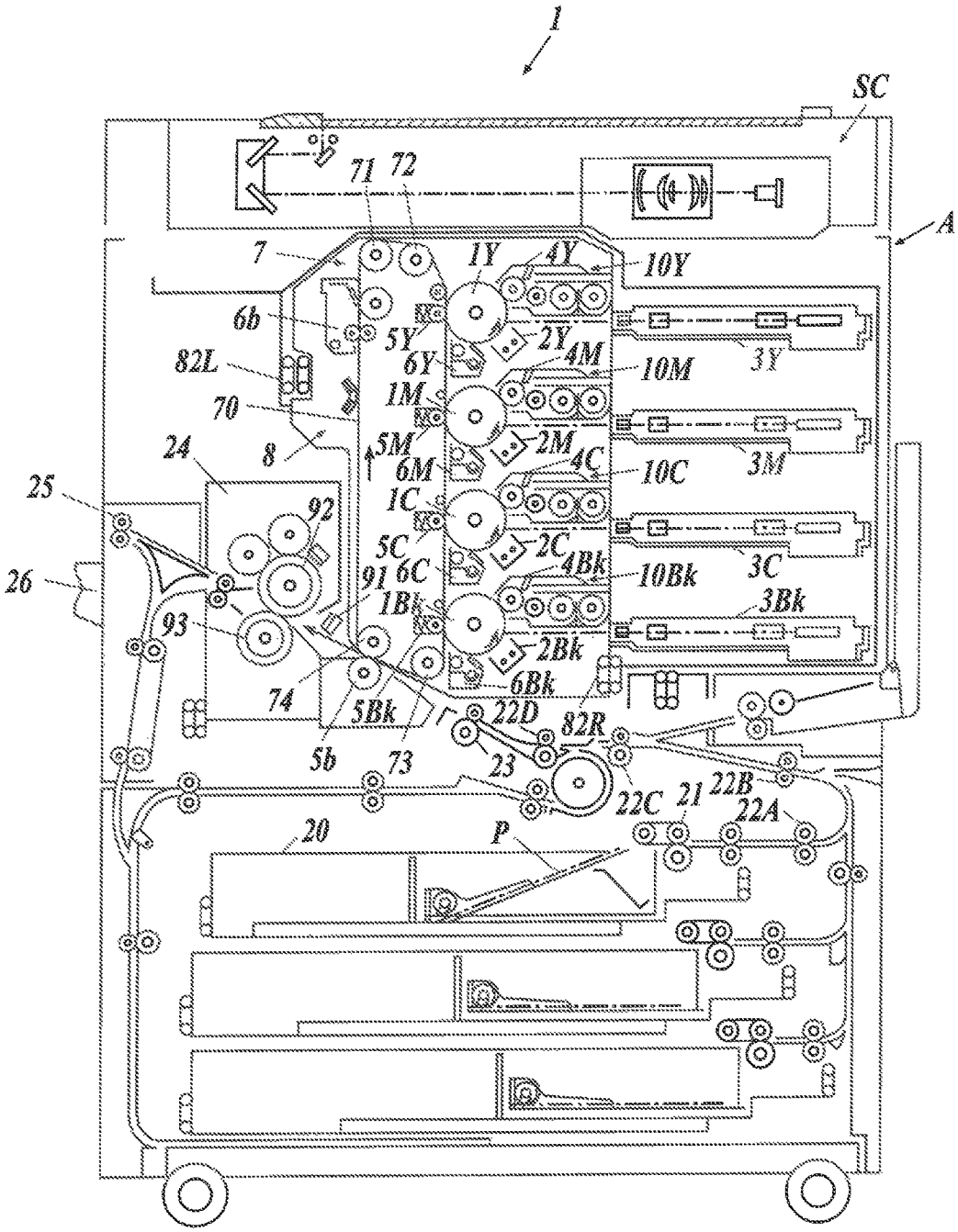
1
SC
A
71
72
7
1Y
4Y
10Y
6b
5Y
2Y
6Y
4M
10M
3Y
82L
1M
70
5M
2M
24
8
6M
4C
10C
3M
25
92
1C
5C
2C
26
91
6C
4Bk
10Bk
3C
1Bk
3Bk
93
2Bk
6Bk
74
5Bk
22D
82R
5b
73
23
22C
21
22B
22A
20
P

IMAGE FORMING APPARATUS AND METHOD USING UV LIGHT AND TONER WITH UV ABSORBER

BACKGROUND

1. Technological Field

The present invention relates to an image forming apparatus and an image forming method. More specifically, the present invention relates to an image forming apparatus and an image forming method which provide excellent fixing property and high color reproducibility.

2. Description of the Related Art

Thermal fixation is currently used as a primary method for fixation, however, in order to improve operability (warming-up time: WUT), to save energy, and to expand kinds of supported media, there has been proposed a system to perform fixation by external stimuli other than heating. In particular, attention has been paid to optical fixing systems, which can be applied to an electrophotographic processing relatively easily without harm by healing.

There has been reported an optical fixing system may convert light energy to thermal energy by adding a near-infrared absorber to a toner and performing irradiation with infrared rays (see Japanese Patent Application Laid Open Publication No. hei 11-38667).

Japanese Patent Application Laid Open Publication No. hei 11-38667 proposes a color toner including an infrared absorber having a maximum absorbing wavelength within a near-infrared region, that is, within the range of 750 to 1100 nm. However, because the infrared absorber also absorbs visible light (wavelength range: 780 nm or less), more visible light is absorbed by adding a large amount of infrared absorber to improve efficiency of light absorbance by the toner. This results in a problem of low color reproducibility of the fixed toner image. Alternatively, if the amount of the infrared absorber is reduced in order to improve color reproducibility, there is a problem of deteriorated fixing property due to insufficient energy.

SUMMARY

An object of the present invention is to provide an image forming method and an image forming apparatus having excellent fixing property and high color reproducibility.

In order to achieve the abovementioned object, according to an aspect of the present invention, there is provided an image forming method using a toner including toner particles including a binder resin and an ultraviolet light absorber, wherein content of the ultraviolet light absorber is within a range of 0.1 to 50 mass % with respect to total mass of the toner particles, the method including:

transferring a toner image formed with the toner on a recording medium; and irradiating the toner image transferred on the recording medium with monochromatic light having a maximum emission wavelength within a wavelength range of 280 to 550 nm to melt and fix the toner image.

According to another aspect of the present invention, there is provided an image forming apparatus employing the image forming method according to the present invention, including:

a transfer unit to transfer a toner image formed using the toner on a recording medium; and a fixing unit to melt and fix the toner image by irradiating the toner image transferred on the recording medium with monochromatic light having a maximum emission wavelength within a wavelength range of 280 to 550 nm.

BRIEF DESCRIPTION OF THE DRAWING

The advantages and features provided by one or more embodiments of the invention will become more fully understood from the detailed description given hereinbelow and the appended drawing which are given by way of illustration only, and thus are not intended as a definition of the limits of the present invention, wherein:

FIG. 1 schematically shows an example of configuration of an image forming apparatus according to the present invention.

DETAILED DESCRIPTION OF EMBODIMENTS

Hereinafter, one or more embodiments of the present invention will be described with reference to the drawing. However, the scope of the invention is not limited to the disclosed embodiments.

The image forming method of the present invention includes usage of a toner including toner particles including a binder resin and an ultraviolet light absorber, wherein content of the ultraviolet light absorber is in the range of 0.1 to 50 mass % with respect to the total mass of the toner particles. The method includes a step of transferring a toner image formed with the toner on a recording medium and a step of irradiating the loner image transferred on the recording medium with monochromatic light having a maximum emission wavelength within the wavelength range of 280 to 550 nm to melt and fix the toner image.

An expression mechanism or an action mechanism of the effects of the present invention is not clearly identified, but it is supposed as follows.

For example, as shown in Japanese Patent Application Laid Open Publication No. hei 11-38667 described above, according to conventional techniques, the toner image is melted and fixed by adding infrared absorber to the toner and by irradiating the toner with infrared rays. In such cases, because the thermal energy obtained from the infrared rays is small, thermal energy sufficient for fixing property can be obtained by addition of a lot of infrared absorber or by addition of an infrared absorber absorbing infrared rays of relatively short wavelength. However, which results in the reduced color reproducibility described above.

Accordingly, the present inventors have focused on ultraviolet light (UV light) which can provide larger energy than infrared rays and an ultraviolet light absorber which absorbs a lot of UV light.

According to the optical fixing system of the present invention, a compound (an ultraviolet light absorber) irradiated with light to be absorbed having the wavelength range transits from a ground state to an excited state. When the compound returns to the ground state, thermal energy is emitted by deactivation without radiation so that surrounding resin is softened and melted and thereby the totter image is fixed.

Additionally, the ultraviolet light absorber having an absorbing band in a short wavelength range has a relatively small influence on the hue of the toner and can extract large thermal energy, so that photo-thermal conversion and hue may be suitably achieved.

In a preferred embodiment of the present invention, the toner preferably includes a colorant.

In a preferred embodiment of the present invention, the toner preferably includes a releasing agent to improve low temperature fixing property and release property.

In the transferring of the toner image, the toner image is preferably transferred on the recording medium using only a black toner or using at least two toners having different colors from each other.

The ultraviolet light absorber preferably includes at least one selected from a group consisting of a benzophenone ultraviolet light absorber, a benzotriazole ultraviolet light absorber, a triazine ultraviolet light absorber, a cyanoacrylate ultraviolet light absorber, and a dibenzoylmethane ultraviolet light absorber.

In order to improve fixing property, the image forming method preferably includes applying pressure to the toner image transferred on the recording medium after melting and fixing the toner image The present invention provides an image forming apparatus using the above-described image forming method, which includes a transfer unit to transfer a toner image formed using the toner on a recording medium; and a fixing unit to melt and fix the toner image by irradiating the toner image transferred on the recording medium with monochromatic tight having a maximum emission wavelength within a wavelength range of 280 to 550 nm.

The present invention and the constitution elements thereof, as well as configurations and embodiments, will be detailed in the following. In the present description, when two figures are used to indicate a range of value before and after "to", these figures are included in the range as a lowest limit value and an upper limit value.

<<Image Forming Method>>

An image forming method of the present invention uses a toner including toner particles including a binder resin and an ultraviolet light absorber, wherein content of the ultraviolet light absorber is within a range of 0.1 to 50 mass % with respect to the total mass of the toner particles, the method including: transferring a toner image formed with the toner on a recording medium; and irradiating the toner image transferred on the recording medium with monochromatic light having a maximum emission wavelength within the wavelength range of 280 to 550 nm to melt and fix the toner image.

Preferably, the image forming method according to the present invention includes a charging step of charging the surface of the electrophotographic photoreceptor (image carrying member), an exposing step of forming an electrostatic latent image by irradiating the surface of the electrophotographic photoreceptor with light, a developing step of developing the electrostatic latent image with a toner to form a toner image, a transferring step of transferring the toner image on a recording medium, an irradiation step of irradiating the toner image transferred on the recording medium with monochromatic light having a maximum emission wavelength within the wavelength range of 280 to 550 nm to melt and fix the toner image, and a cleaning step of removing the residual toner on the electrophotographic photoreceptor.

The image forming method may also include a pressure applying step of applying pressure to the toner image transferred on the recording medium, preferably after the light irradiation step.

(Charging Step)

In this step, the electrophotographic photoreceptor is charged. The method of charging may be, but not limited to, a contact or contactless roller charging type.

(Exposing Step)

In this step, an electrostatic latent image is formed on the electrophotographic photoreceptor (an electrostatic latent image carrying member).

The electrophotographic photoreceptor may be, but not limited to, a drum shape photoreceptor made of a known organic photoreceptor, for example.

Formation of the electrostatic latent image is performed by, as described below, charging the surface of the electrophotographic photoreceptor uniformly with a charger and by exposing the surface of the electrophotographic photoreceptor imagewise with an exposing means.

The exposing means is not particularly limited and may include LEDs composed of light emitting elements arrayed in the axial direction of the electrophotographic photoreceptor 1Y and imaging elements or may be a laser optical system.

(Developing Step)

In the developing step, a toner image to formed by developing the electrostatic latent image is using a dry type developer including a toner.

Formation of the toner image using a dry type developer including the toner can be performed, for example, with a developing sleeve incorporating a magnet and rotating with the developer retained and a voltage applying device applying a direct current and/or alternating current bias voltage between the developing sleeve and the photoreceptor. More specifically, the toner and the carrier are mixed and stirred so that the toner charged by their friction to retained on the surface of the rotating magnet roller to form a magnetic brush. Since the magnetic roller to disposed at a neighborhood of the electrophotographic photoreceptor, a part of the toner that constitutes the magnetic brush formed on the surface of the magnetic roller is transferred by an electrical attraction force to the surface of the electrophotographic photoreceptor. As a result, the electrostatic latent image is developed with the toner and the toner image to formed on the surface of the electrophotographic photoreceptor.

(Transferring Step)

In this step, the toner image to transferred on the recording medium.

The transfer of the toner image on the recording medium is performed by peel charging of the toner image on the recording medium.

As a transferring means, for example, a corona transferring device with corona discharge, a transfer belt, or a transfer roller can be used.

The transferring step may be performed, for example, using an intermediate transferring member, by first transfer of the toner image is on the intermediate transferring member, then by second transfer of the toner image on the recording medium. Alternatively, the toner image formed on the electrophotographic photoreceptor is directly transferred to the recording medium.

Examples of the recording medium include, but are not particularly limited to, normal paper from thin paper to thick paper, high-quality paper, coated printing paper such as art paper and coated paper, commercially available Japanese paper and postcard paper, plastic film for OHP, cloth, and the like (Fixing Step)

(1) Light Irradiation Step

In this step, the toner image transferred on the recording medium is irradiated with monochromatic light having a maximum emission wavelength within the wavelength range of 280 to 550 nm to melt and fix the toner image.

A light source for the monochromatic light refers to a light source such as an LED (Light Emitting Diode) or an LD (Laser Diode: semiconductor laser) which emits light having a single frequency or which emits light having a frequency within a very small range around a specific frequency defined by a single wavelength or having a wavelength within a very small range around a specific wavelength. In the present invention, the monochromatic light refers to light having a wavelength range within a wavelength corresponding to a minimum emission intensity (a maximum emission wavelength) nm±20 nm.

The maximum emission wavelength of the irradiated monochromatic light is within the wavelength range of 280 to 550 nm. If the maximum emission wavelength is less than 280 nm, bond cleavage occurs and thereby color reproducibility is reduced. If the maximum emission wavelength is more than 550 nm, the obtained energy is not sufficient for achieving sufficient fixing property.

The maximum emission wavelength is preferably within the wavelength range of 300 to 480 nm. If the maximum emission wavelength is 300 nm or more, the loss of energy due to the bond cleavage is email and thereby fixing property is improved. If the maximum emission wavelength is 480 nm or less, overlapping wavelength with the wavelength absorbed by the ultraviolet light absorber is large so that larger energy is obtained and the fixing property is improved.

Irradiation amount of the monochromatic light is preferably within a range of 0.01 to 100 J/cm$^2$, more preferably within 0.05 to 50 J/cm$^2$.

(2) Pressure Applying Step

In this step, the toner image transferred on the recording medium is fixed on the recording medium. Specifically, for example, a fixing roller and a pressure roller are pressed against each other so that a fixing nip portion is formed at the fixing roller in this step.

In such cases, the fixing roller may be used as a heating means. The toner image melted by light irradiation is further softened by heating so that the fixing property onto the recording medium can be improved. The temperature of the fixing roller is preferably within the range of 30 to 100° C., more preferably within the range of 40 to 100° C.

(Cleaning Step)

In this step, a liquid developer which has not been used to form images or which remains without being transferred is removed from developer carrying member such as a developing roller, the photoreceptor, and intermediate transferring member.

The cleaning method is not particularly limited, but it is preferable to use a method which uses a blade having a tip disposed in contact with the photoreceptor, and scratching the surface of the photoreceptor. For example, in this step, a cleaning blade and a brush roller disposed at an upstream side of the cleaning blade can be used.

<<Image Forming Apparatus>>

The image forming apparatus according to the present invention uses the above-described image formation method and includes a transfer unit to transfer the toner image formed with the toner on the recording medium, and a fixing unit to melt and fix the toner image by irradiating the toner image transferred on the recording medium with monochromatic light having a maximum emission wavelength within the wavelength range of 280 to 550 nm.

Hereinafter, an image forming apparatus applicable to the present invention is described in reference to the drawing.

An image forming apparatus illustrated in FIG. 1 may be referred to as a tandem color image forming apparatus, and includes four image forming units (process cartridge) 10Y, 10M, 10C, and 10Bk, an intermediate transferring unit 7 having an endless belt form, a sheet feeding unit 21, and a fixing unit 24. The image forming apparatus further includes a document scanner SC above a main body A of the image forming apparatus.

Four image forming units (process cartridge) 10Y, 10M, 10C, and 10Bk are included in the image forming apparatus according to FIG. 1, however, only an image forming unit Bk, or at least two image forming units among the four image forming units (process cartridge) 10Y, 10M, 10C, and 10Bk may be included.

The image forming unit 10Y forms a yellow image. The image forming unit 10Y includes a drum shape electrophotographic photoreceptor 1Y around which a charging unit 2Y, an exposing unit 3Y, a developing unit 4Y, and a cleaning unit 6Y are arranged. The image forming unit 10Y further includes a primary transfer roller 5Y.

The image forming unit 10M forms a magenta image. The image forming unit 10M includes a drum shape electrophotographic photoreceptor 1M around which a charging unit 2M, an exposing unit 3M, a developing unit 4M, and a cleaning unit 6M are arranged. The image forming unit 10M further includes a primary transfer roller 5M.

The image forming unit 10C forms a cyan image. The image forming unit 10C includes a drum shape electrophotographic photoreceptor 1C around which a charging unit 2C, an exposing unit 3C, a developing unit 4C, and a cleaning unit 6C are arranged. The image forming unit 10C further includes a primary transfer roller 5C.

The image forming unit 10Bk forms a black image. The image forming unit 10Bk includes a drum shape electrophotographic photoreceptor 1Bk around which a charging unit 2Bk, an exposing unit 3Bk, a developing unit 4Bk, and a cleaning unit 6Bk are arranged. The image forming unit 10Bk further includes a primary transfer roller 5Bk.

The image forming units 10Y, 10M, 10C, and 10Bk have the same configuration except for the colors of toner images formed on the electrophotographic photoreceptors 1Y, 1M, 1C, and 1Bk. Thus, the following description focuses on the image forming unit 10Y as an example.

In the present embodiment, in the image forming unit 10Y, at least the electrophotographic photoreceptor 1Y, the charging unit 2Y, the developing unit 4Y, and the cleaning unit 6Y are integrated.

The charging unit 2Y provides the electrophotographic photoreceptor 1Y with a uniform electric potential to charge (for example, negatively charge) the surface (for example, the surface of the protective layer of the electrophotographic photoreceptor) of the electrophotographic photoreceptor 1Y. The charging unit 2Y may charge the surface of the electrophotographic photoreceptor 1Y by a non-contact charging method, but preferably charge the surface of the electrophotographic photoreceptor 1Y by a contact charging method described later.

The exposing unit 3Y exposes the surface of the electrophotographic photoreceptor 1Y (for example, the surface of the protective layer of the electrophotographic photoreceptor) which has been given the uniform potential by the charging unit 2Y on the basis of image signals (yellow), to form an electrostatic latent image corresponding to the yellow image. The exposing unit 3Y may include LEDs composed of light emitting elements arrayed in the axial direction of the electrophotographic photoreceptor 1Y and imaging elements (SELFOC (registered trade name) lens), or may be a laser optical system.

The developing unit 4Y forms a toner image by developing the electrostatic latent image formed by the exposing unit 3Y with an electrostatic latent image developer.

Although the electrostatic latent image developer is not specifically limited, it is preferably use a dry type developer.

In the image forming apparatus according to the present embodiment, the electrophotographic photoreceptor 1Y, the charging unit 2Y, the exposing unit 3Y, the developing unit 4Y, and the cleaning unit 6Y are integrated as a process cartridge. This process cartridge may be detachably attached to the apparatus main body A. In addition, at least one of the charging unit 2Y, the exposing unit 3Y, the developing unit 4Y, transferring unit or separator unit, and the cleaning unit 6Y may be integrally supported together with the electrophotographic photoreceptor 1Y to constitute a process cartridge, detachably attached to the apparatus main body A to form a single image forming unit. The single image forming unit may be detachably attached to the apparatus main body A using a guiding device such as a rail.

A housing 8 includes the image forming units 10Y, 10M, 10C, and 10Bk, and the intermediate transferring unit 7 having an endless belt form. The housing 8 has a structure which can be drawn from the apparatus main body A via supporting rails 82L and 82R. In the housing 8, the image forming units 10Y, 10M, 10C, and 10Bk are tandemly arranged in the vertical direction. The intermediate transferring unit 7 having an endless belt form is arranged in the left side of the photoreceptors 1Y, 1M, 1C, and 1Bk in FIG. 1. The intermediate transferring unit 7 contains a rotatable endless belt type intermediate transfer member 70 which is wound around rollers 71, 72, 73, and 74, first transfer rollers 5Y, 5M, 5C, and 5Bk, and a cleaning unit 6*b*.

The fixing unit 24 at least includes a light irradiating unit 91. The device constituting the light irradiating unit 91 includes, as described above, an LED and an LD which emits monochromatic light. The maximum emission wavelength of the irradiated monochromatic light from the light irradiating unit 91 is within a wavelength range of 280 to 550 nm. Irradiation amount of the monochromatic tight is preferably within a range of 0.01 to 100 J/cm$^2$, more preferably within 0.05 to 50 J/cm$^2$.

Light source of the monochromatic light used as the tight irradiating unit 91 may be provided alone or in combination.

The fixing unit 24 may have a pressure applying unit to press the toner image formed on the recording medium P. More preferably, the pressure applying unit is provided at the downstream side of the light irradiating unit 91 in the conveying direction of the recording medium.

The pressure applying unit includes a fixing roller 92 and a pressure applying roller 93. When a recording medium having a toner image is supplied, the fixing roller 92 and the pressure applying roller 93 crimp the toner image onto the recording medium P. Fixing property can be further improved by applying pressure on the toner image melted and fixed at the light irradiating unit 91.

The fixing roller 92 can heat the toner image on the recording medium P while the recording medium P passes through the fixing roller 92 and the pressure applying roller 93. The toner image softened by light irradiation is further softened by this heating, so that the fixing property of the toner image onto the recording medium P is further improved. The temperature of the fixing roller 92 is preferably within the range of 30 to 100° C., more preferably within the range of 40 to 100° C.

Hereinafter, an image formation method using the image forming apparatus in FIG. 1 is described.

Each of the images formed by the image forming units 10Y, 10M, 10C, and 10Bk is sequentially transferred, by the primary transfer rollers 5Y, 5M, 5C, and 5Bk, onto the rotating primary intermediate transferring member 70 having an endless belt form. An integrated color image is thereby formed.

A recording medium P accommodated in a sheet feeding cassette 20 is fed by the sheet feeding unit 21, and is transported to a second transferring roller 5*b* via multiple intermediate rollers 22A, 22B, 22C, and 22D and register rollers 23. The integrated color image is subjected to secondary transfer to the recording medium P by the second transferring roller 5*b*. Thus, a color image is transferred to the recording medium collectively. After the secondary transfer of the integrated color image on the recording medium P, the endless belt type intermediate transfer member 70 will separate the recording medium P by curvature.

The recording medium P is irradiated with monochromatic light having a maximum emission wavelength within the wavelength range of 280 to 550 nm at the light irradiating unit 91 of the fixing unit. The toner image melted and fixed on the recording medium P is further subjected to fixation onto the recording medium P by the fixing roller 92 and the pressure applying roller 93.

The recording medium P subjected to fixation treatment is pinched between discharging rollers 25 and conveyed to a sheet receiving tray 26 provided outside of the apparatus. The electrostatic latent image developer (residual toner) on the intermediate transferring member 70 is removed by the cleaning unit 6*b*.

In forming images, the primary transfer roller 5Bk is always in contact with the surface of the electrophotographic photoreceptor 1Bk. Meanwhile, the primary transfer rollers 5Y, 5M, and 5C are respectively in contact with the surface of the corresponding electrophotographic photoreceptors 1Y, 1M, and 1C only in forming color images. The secondary transfer roller 5*b* is in contact with the surface of the intermediate transfer member 70 having an endless belt form only when the recording medium P passes the secondary transfer roller and the secondary transfer is performed.

<<Toner for Developing Electrostatic Latent Image>>

A toner for developing electrostatic latent image according to the present invention (hereinafter may be simply referred to as a toner) is preferably an assembly of toner base particles or toner particles.

Here, a timer particle refers to a toner base particle with an external additive. The toner particle itself may be the toner base particle as it is.

In the present invention, the toner particle is includes at least a binder resin and an ultraviolet tight absorber.

(Ultraviolet Light Absorber)

The ultraviolet light absorber according to the present invention has an absorbing wavelength within the wavelength range of 180 to 400 nm. The ultraviolet light absorber may be an organic compound or an inorganic compound, provided that it refers to an additive deactivated from an excited state by non-radiative deactivation without structure change such as isomerization or bond cleavage at least under an environment where the temperature is 0° C. or more. Examples of the ultraviolet light absorber according to the present invention include, other than commonly used organic ultraviolet light absorbers, an additive such as light stabilizer or antioxidant.

Additionally, ultraviolet light absorbing polymer having a polymer chain including functional groups of organic ultraviolet light absorber skeleton can be used.

The ultraviolet light absorber preferably has a maximum absorption wavelength within a range of 180 to 400 nm. An organic ultraviolet light absorber is more preferred than an inorganic ultraviolet light absorber.

Examples of organic ultraviolet light absorbers used in the present invention include known organic ultraviolet light absorbers such as a benzophenone ultraviolet light absorber, a benzotriazole ultraviolet light absorber, a triazine ultraviolet light absorber, a cyanoacrylate ultraviolet light absorber, a salicylate ultraviolet light absorber, a benzoate ultraviolet light absorber, a diphenylacrylate ultraviolet light absorber, a benzoic acid ultraviolet light absorber, a salicylic acid ultraviolet light absorber, a cinnamic acid ultraviolet light absorber, a dibenzoylmethane ultraviolet light absorber, a β,β-diphenylacrylate ultraviolet light absorber, a benzylidene camphor ultraviolet light absorber, a phenyl benzimidazole ultraviolet light absorber, an anthranil ultraviolet light absorber, an imidazoline ultraviolet light absorber, a benzalmalonate ultraviolet light absorber, and a 4,4-diaryl butadiene ultraviolet light absorber. Among them, a benzophenone ultraviolet light absorber, a benzotriazole ultraviolet light absorber, a triazine ultraviolet light absorber, a cyanoacrylate ultraviolet light absorber, and a dibenzoylmethane ultraviolet light absorber are preferably used.

They may be used alone or in combination of two or more kinds.

Examples of the benzophenone ultraviolet light absorber (ultraviolet light absorber including a benzophenone compound) include octabenzone, 2,4-hydroxybenzophenone, 2-hydroxy-4-methoxybenzophenone, and 2-hydroxy-4-n-octyloxybenzophenone.

Examples of the benzotriazole ultraviolet light absorber (ultraviolet light absorber including a benzotriazole compound) include 2-(2p-cresol,2-(2H-benzotriazole-2-yl)-4,6-bis(1-methyl-1-phenylethyl)phenol, 2-[5-chloro(2H)-benzotriazole-2-yl]-4-methyl-6-(tert-butyl)phenol, 2-(2H-benzotriazole-2-yl)-4,6-di-tert-pentylphenol, 2-(2H-benzotriazole-2-yl)-4-(1,1,3,3-tetramethylbutyl)phenol, reaction products of methyl-3-[3-t-butyl-5-(2H-benzotriazol-2-yl)-4-hydroxyphenyl]propionate/polyethylenglycol (molecular weight: about 300), 2-(2H-benzotriazole-2-yl)-6-dodecyl-4-methylphenol, 2-(2-hydroxy-5-tert-butylphenyl)-2H-benzotriazole, 2-ethylhexyl-3-[3-tert-butyl-4-hydroxy-5-(5-chloro-2H-benzotriazole-2-yl)phenyl] propionate, 2-(2H-benzotriazole-2-yl)-4,6-bis(1-methyl-1-phenylethyl)phenol, and 2-(2H-benzotriazole-2-yl)-6-(1-methyl~1-phenylethyl)-4-(1,1,3,3-tetramethylbutyl)phenol.

Examples of the triazine ultraviolet light absorber (ultraviolet light absorber including a triazine compound) include 2-(4,6-bis(2,4-dimethylphenyl)-1,3,5-triazin-2-yl)-5-hydroxyphenyl, 2-(4,6-diphenyl-1,3,5-triazin-2-yl)-5-(hexyloxy)phenol, 2-[4-[(2-hydroxy-3-dodecyloxypropyl)oxy]-2-hydroxyphenyl]-4,6-bis(2,4-dimethylphenyl)-1,3,5-triazine, 2-[4-[(2-hydroxy-3-(2'-ethyl)hexyl)oxy]-2-hydroxyphenyl]-4,6-bis(2,4-dimethylphenyl)-1,3,5-triazine, 2,4-bis(2-hydroxy-4-butyloxyphenyl)-6-(2,4-bis-butyloxyphenyl)-1,3,5-triazine, and 2-(2-hydroxy-4-[1-octyloxycarbonylothoxy] phenyl)-4,6-bis(4-phenyl)-1,3,5-triazine.

Examples of the cyanoacrylate ultraviolet light absorber (ultraviolet light absorber including a cyanoacrylate compound) include ethyl2-cyano-3,3-diphenylacrylate and 2'-ethylhexyl2-cyano-3,3-diphenylacrylate.

Examples of the dibenzoylmethane ultraviolet light absorber (ultraviolet light absorber including a dibenzoylmethane compound) include 4-tert-butyl-4'-methoxydibenzoylmethane (for example, "Parsol 1789" manufactured by DSM).

Examples of the inorganic ultraviolet light absorber include titanium oxide, zinc oxide, cerium oxide, iron oxide, and barium sulfide. The diameter of the inorganic ultraviolet light absorber is preferably within 1 nm to 1 μm.

The content of the ultraviolet light absorber is in the range of 0.1 to 50 mass % with respect to the total mass (100 mass %) of the toner particles. If the content is less than 0.1 mass %, sufficient heat (energy) cannot be obtained. If the content is more than 50 mass %, the fixed image easily peels off.

The content of the ultraviolet light absorber preferably within the range of 0.5 to 35 mass %. If the content is 0.5 mass % or more, obtained heat energy becomes so large that fixing property is further improved. If the content is 35 mass % or less, the ratio of resin becomes so large that the image is strongly fixed and that fixing property is further improved.

(Binder Resin)

The toner particles according to the present invention include a binder resin. Inclusion of the binder resin provides toner having suitable viscosity and suppresses bleeding when applied on paper, and thereby improves reproducibility of thin lines and reproducibility of dots.

A resin generally used as a binder resin constituting the toner particles can be used as the binder resin without limitation as the binder resin. Specific examples thereof include styrene resin, acrylic resin, styrene-acrylic resin, polyester resin, silicone resin, olefin resin, amide resin, and epoxy resin. These binder resins may be used alone, or they may be used in combination of two or more kinds.

Among these resins, the binder resin is preferably at least one selected from the group consisting of styrene resin, acrylic resin, styrene-acrylic resin, and polyester resin from the viewpoint of becoming low viscosity when melted, and having a highly sharp melt property. It is more preferable to use at least one selected from the group consisting of styrene-acrylic resin and polyester resin.

A glass transition temperature ($T_g$) of a binder resin is preferably in the range of 35 to 70° C. from the viewpoint of fixing property and heat-resisting storage property. More preferably, it is preferably in the range of 35 to 60° C. The glass transition temperature ($T_g$) can be measured with differential scanning colorimetry (DSC).

The toner particles including the binder resin may have a single-layer structure or a core-shell structure. The kind of binder resin used as a core particle and a shell layer in the core-shell structure is not particularly limited.

(Colorant)

The toner particles according to the present invention may contain a colorant. The colorant may be a generally known dye or pigment.

Examples of a colorant to obtain a black toner are: carbon black, a magnetic material, and iron-titanium complex oxide black.

Examples of carbon black that may be used include: channel black, furnace black, acetylene black, thermal black, and lamp black. Examples of a magnetic material that may be used include: ferrite and magnetite.

Examples of a colorant to obtain a yellow toner are: dyes such as C.I. Solvent Yellow 19, C.I. Solvent Yellow 44, C.I. Solvent Yellow 77, C.I. Solvent Yellow 79, C.I. Solvent Yellow 81, C.I. Solvent Yellow 82, C.I. Solvent Yellow 93, C.I. Solvent Yellow 98, C.I. Solvent Yellow 103, C.I. Solvent Yellow 104, C.I. Solvent Yellow 112, C.I. and Solvent Yellow 162; and pigments such as C.I. Pigment Yellow 14, C.I. Pigment Yellow 17, C.I. Pigment Yellow 74, C.I. Pigment Yellow 93, C.I. Pigment Yellow 94, C.I. Pigment Yellow 138, C.I. Pigment Yellow 155, C.I. Pigment Yellow 180, and C.I. Pigment Yellow 185.

Examples of a colorant to obtain a magenta toner are: dyes such as C.I. Solvent Red 1, C.I. Solvent Red 49, C.I. Solvent Red 52, C.I. Solvent Red 58, C.I. Solvent Red 63, C.I. Solvent Red 111, and C.I. Solvent Red 122; and pigments such as C.I. Pigment Red 5, C.I. Pigment Red 48:1, C.I. Pigment Red 53:1, C.I. Pigment Red 57:1, C.I. Pigment Red 122, C.I. Pigment Red 123, C.I. Pigment Red 139, C.I. Pigment Red 144, C.I. Pigment Red 166, C.I. Pigment Red 177, C.I. Pigment Red 178, and C.I. Pigment Red 222.

Examples of a colorant to obtain a cyan toner are: dyes such as C.I. Solvent Blue 25, C.I. Solvent Blue 36, C.I. Solvent Blue 60, C.I. Solvent Blue 70, C.I. Solvent Blue 93, and C.I. Solvent Blue 95; and pigments such as C.I. Pigment Blue 1, C.I. Pigment Blue 7, C.I. Pigment Blue 15, C.I. Pigment Blue 15:3, C.I. Pigment Blue 60, C.I. Pigment Blue 62, C.I. Pigment Blue 66, and C.I. Pigment Blue 76.

One kind of colorant or a combination of two or more kinds of colorants may be used to obtain each toner.

A content of the colorant with respect to the total mass of the toner particles (100 mass %) is preferably in the range of 1 to 30 mass %, and more preferably in the range of 2 to 20 mass %. The content of 1 mass % or more results in sufficient coloring property. If the content is 30 mass % or less, high quality images can be obtained by stable charging property because the colorant does not release from the toner or adhere to the carrier.

<Releasing Agent>

The toner particles according to the present invention may contain a releasing agent. A usable releasing agent is not limited in particular. Various known waxes may be used.

Examples of the wax are: low molecular weight polypropylene, polyethylene, oxidized low molecular weight polypropylene, polyolefin such as polyethylene, paraffin, and synthetic ester wax.

It is particularly preferable to use a synthetic ester wax such as behenyl behenate, glycerin tribehenate, or pentaerythritol tetrabehenate due to low melting temperature and low viscosity.

A content ratio of the releasing agent is preferably in the range of 1 to 30 mass % with respect to the total mass (100 mass %) of toner particles, more preferably it is in the range of 3 to 15 mass %.

<Charge Control Agent>

The toner particles according to the present invention may contain a charge control agent. The used charge control agent is not limited in particular as long as it is a substance that is colorless and capable of providing positive or negative charge by a triboelectric charging. Various known charge control agents that are positively chargeable or negatively chargeable may be used.

The content ratio of the charge control agent is preferably in the range of 0.01 to 30 mass % with respect to the total mass (100 mass %) of toner particles, and more preferably it is in the range of 0.1 to 10 mass %.

<External Additive>

In order to improve fluidity, charging property, and cleaning property of the toner, an external additive such as fluidity increasing agent and cleaning assisting agent may be added on the surface of the toner base particles as an after treatment agent.

Examples inorganic particles used as the external additive are: inorganic oxide particles such as silica particles, alumina particles, and titanium oxide particles; inorganic stearic acid compound particles such as aluminum stearate particles and zinc stearate particles; and inorganic particles of inorganic titanium acid compound particles such as strontium titanate particles and zinc titanate particles.

These may be used alone, or they may be used in combination of two or more kinds.

From the viewpoint of improving heat-resisting storage stability and environmental stability, these inorganic particles may be subjected to a surface treatment by a silane coupling agent, a titanium coupling a higher aliphatic acid, or a silicone oil.

The added amount of the external additive is preferably in the range of 0.05 to 5 mass % with respect to the total mass of the toner particles (100 mass %). More preferably, it is in the range of 0.1 to 3 mass %.

<Average Particle Size of Toner Particles>

It is preferable that the toner particles have average particle size within the range of 4 to 10 μm, more preferably 4 to 7 μm in volume-based median diameter ($D_{50}$). When the volume-based median diameter ($D_{50}$) is within the above-described range, the transfer efficiency is improved, the quality of halftone image is improved, and the image quality such as fine lines and dots is improved.

The volume-based median diameter ($D_{50}$) of the toner particles is measured and calculated by using measuring device including a "COULTER COUNTER 3" (manufactured by Beckman Coulter Inc.) and a computer system installed with data processing software "Software V3.51" (manufactured by Beckman Coulter Inc.) connected thereto.

In the measuring process, 0.02 g of sample to be measured (the toner) is added to 20 mL of a surfactant solution (a surfactant solution for the purpose of dispersing the toner particles, for example, in which a neutral detergent including a surfactant component is diluted by 10 times with pure water), ultrasonic dispersion is performed for 1 minute to prepare a toner particle dispersion liquid. This toner particle dispersion liquid is poured into a beaker including ISOTON II (manufactured by Beckman Coulter, Inc.) in a sample stand by a pipette until the measuring device displays a concentration of 8 mass %.

By setting this concentration range, it is possible to obtain a reproducible measurement value. Then, the counter of the particle to be measured is set to be 25,000. The aperture diameter is set to be 50 μm. The frequency count is calculated by dividing the measurement range of 1 to 30 μm by 256. The particle size where the accumulated volume counted from the largest size reaches 50% is determined as the volume-based median diameter ($D_{50}$).

<Manufacturing Method of Toner>

The manufacturing method of the toner according to the present invention may be any known method and preferably includes, but not limited to, an emulsion polymerization coagulation method and an emulsion coagulation method.

The emulsion polymerization coagulation method is a method in which toner particles are manufactured as follows: a binder resin particle dispersion liquid prepared by the emulsion aggregation method, a ultraviolet light absorber particle dispersion liquid, a colorant particle dispersion liquid, and a dispersion liquid of release agent such as wax are mixed and aggregated until toner particles have a desired diameter; and fusion among the binder resin particles is further conducted to control the shape.

The emulsion aggregation method is a method in which toner particles are manufactured as follows: a binder resin solution obtained by dissolving a binder resin in a solvent is added dropwise into a poor solvent; the resin particle dispersion liquid, an ultraviolet light absorber particle dispersion liquid, a coloring agent particle dispersion liquid, and a dispersion liquid of release agent such as wax are mixed and aggregated until toner particles have a desired diameter; and fusion among the binder resin particles is further conducted to control the shape.

The toner according to the present invention can be manufactured by either manufacturing method.

An example of a case where the emulsion coagulation method is used for producing the toner of the present invention is described below.

(1) A step of preparing a dispersion liquid in which colorant particles are dispersed in an aqueous medium;

(2) A step of preparing a dispersion liquid in which ultraviolet light absorber particles are dispersed in an aqueous medium;

(3) A step of preparing a dispersion liquid in which binder resin particles containing an internal additive as needed are dispersed in an aqueous medium;

(4) A step of preparing a binder resin particle dispersion liquid by emulsion polymerization;

(5) A step of forming toner base particles by mixing the colorant particle dispersion liquid, the ultraviolet light absorber particle dispersion liquid, and the binder resin particle dispersion liquid to aggregate, associate, and fuse the colorant particles, the ultraviolet light absorber particles, and the binder resin particles;

(6) A step of removing a surfactant and the like by filtering the toner base particles from a dispersion system (aqueous medium) of the toner base particles;

(7) A step of drying the toner base particles; and (8) A step of adding an external additive to the toner base particles.

When the toner is manufactured by the emulsion polymerization coagulation method, the binder resin particles obtained by emulsion polymerization may have a multilayer structure of two or more layers composed of binder resins of different composition. The binder resin particles of such structure, such as a two-layer structure can be obtained as follows: emulsion polymerization (first polymerization) in accordance with a usual method is performed to prepare a the resin particle dispersion liquid; a polymerization initiator and a polymerizable monomer are added to the dispersion liquid; and polymerization (second polymerization) of the system is performed.

Toner particles having a core-shell structure can be obtained by the emulsion polymerization coagulation method. Specifically, the toner particles having a core-shell structure are prepared as follows: first, core particles are prepared by aggregating, associating, and fusing binder resin particles, ultraviolet light absorber particles, and colorant particles for core particles; and subsequently, binder resin particles for shell layer are added to the core particle dispersion liquid so as to aggregate and fuse the binder resin particles for shell layer on the surface of the core particles to form a shell layer coating the surface of the core particles.

<<Developer>>

The toner according to the present invention can be suitably used, for example, as a single-component magnetic toner including a magnetic material, as a two-component developer with a so-called carrier mixed, as a nonmagnetic toner alone, or the like.

For example, magnetite, γ-hematite, or various kinds of ferrite may be used as the magnetic material.

The carrier composing the two-component developer may be magnetic particles composed of conventionally known materials including a metal such as iron, steel, nickel, cobalt, ferrite, and magnetite, and an alloy of the metal with a metal such as aluminum or lead, and the like.

Preferably used carriers include a coated carrier including magnetic particles having a surface coated by a coating agent such as a resin, and a so-called resin dispersed-type carrier including magnetic material powder dispersed in a binder resin. Examples of resin for coating include, but not particularly limited to, olefin resin, styrene resin, styrene-acrylic resin, silicone resin, polyester resin, fluororesin, and the like. Examples of resin for the resin dispersed-type carrier include, but not particularly limited to, known resins such as acrylic resin, styrene-acrylic resin, polyester resin, fluororesin, phenol resin, and the like.

It is preferable that the carrier has volume-based median diameter within the range of 20 to 100 μm, more preferably 25 to 80 μm. The volume-based median diameter of the carrier can be measured by a laser diffraction particle size analyzer "HELOS" (manufactured by SYMPATEC GmbH) including a wet dispersion device.

The amount of toner mixed to carrier is preferably within the range of 2 to 10 mass % with respect to the total mass of the toner and the carrier (100 mass %)

EXAMPLES

Hereinafter, the present invention will be described in reference to specific examples, but the present invention is not limited thereto.

<<Production of Toner>>

Toners 1 to 17 are produced as follows.

<Production of Toner 1>

(1) Preparation of Styrene-Acrylic Resin Particle Dispersion Liquid 1

(First Polymerization)

Into a reaction vessel equipped with a stirrer, a temperature sensor, a cooling tube, and a nitrogen introducing device, a solution containing 8 mass parts of sodium dodecyl sulfate dissolved in 3,000 mass parts of ion-exchanged water was charged. While stirring at a stirring speed of 230 rpm under a nitrogen flow, the inner temperature of the reaction vessel was raised to 80° C. After the temperature was raised, a solution of 10 mass parts of potassium persulfate dissolved in 200 mass parts of ion-exchanged water was added thereto, and the liquid temperature was raised again to 80° C. To this solution was dropwise added a polymerizable monomer solution including the following Monomer mixture 1 over 1 hour.

(Monomer Mixture 1)

Styrene: 480 mass parts;

n-Butyl acrylate: 250 mass parts;

Methacrylic acid: 68.0 mass parts; and n-Octyl-3-mercaptopropionate 16.0 mass parts.

Then, the reaction system was heated and stirred at 80° C. for 2 hours to carry out the polymerization. A Styrene-acrylic resin particle dispersion liquid 1A was thus prepared. This dispersion liquid 1A contains Styrene-acrylic resin particles 1a.

(Second Polymerization)

Into a reaction vessel equipped with a stirrer, a temperature sensor, a cooling tube, and a nitrogen introducing device, a solution of 7 mass parts of sodium polyoxyethylene-2-dodecyl ether sulfite dissolved in 800 mass parts of ion-exchanged water was charged. After heating the solution to 98° C. were added 260 mass parts of the above Styrene-acrylic resin particle dispersion liquid 1A and a polymerizable monomer solution including the following Monomer mixture 2 dissolved at 90° C.

(Monomer Mixture 2)

Styrene: 245 mass parts;

n-Butyl acrylate: 120 mass parts;

n-Octyl-3-mercaptopropionate: 1.5 mass parts; and

Paraffin wax "HNP-11" (manufactured by Nippon Seiro, Co. Ltd.) as a releasing agent: 67 mass parts.

The reaction system was mixed and dispersed for 1 hour by using a mechanical disperser with a circulation route "CLEARMIX" (manufactured by M Technique Co., Ltd.) so that a dispersion liquid containing emulsion particles (oil particles) was prepared.

Then, an initiator solution of 6 mass parts of potassium persulfate dissolved in 200 mass parts of ion-exchanged water was added to the dispersion liquid, and the system was heated and stirred at 82° C. for 1 hour to carry out polymerization. A Styrene-acrylic resin particles dispersion liquid 1B was thus prepared. This dispersion liquid 1B contains styrene-acrylic resin particles 1b.

(Third Polymerization)

A solution of 11 mass parts of potassium persulfate dissolved in 400 mass parts of ion-exchanged water was added to the Styrene-acrylic resin particle dispersion liquid 1B. Then, a polymerizable monomer solution including the following Monomer mixture 3 was added dropwise thereto at a temperature of 82° C. over 1 hour.

(Monomer Mixture 3)

Styrene: 435 mass parts;

n-Butyl acrylate: 130 mass parts;

Methacrylic acid: 33 mass parts; and n-Octyl-3-mercapto propionate: 8 mass parts.

After the addition, the system was heated and stirred for 2 hours to carry out the polymerization. After performing polymerization, the system was cooled to 28° C. Styrene-acrylic resin particle dispersion liquid 1 was thus prepared. This Dispersion liquid contains Styrene-acrylic resin 1.

A particle size of the styrene-acrylic resin particles in the Styrene-acrylic resin particle dispersion liquid 1 was measured with "Microtrac UPA-150" (manufactured by Nikkiso Co., Ltd.) by using a dynamic light scattering method. The particle size was 120 nm in a volume-based median diameter. This Styrene-acrylic resin 1 had a glass transition temperature ($T_g$) of 45° C.

(2) Preparation of Benzophenone Particle Dispersion Liquid 1

80 mass parts of dichloromethane and 20 mass parts of benzophenone (Uvinul3049, manufactured by BASF Japan Co. Ltd.) as a ultraviolet light absorber was mixed and stirred while heating at 50° C. to obtain a liquid including benzophenone. To 100 mass parts of this liquid was added a mixed liquid of 99.5 mass parts of distilled water healed to 50° C. and 0.5 mass parts of 20 mass % sodium dodecylbenzenesulfonate aqueous solution. By stirring at 16000 rpm for 20 minutes using a homogenizer having a shaft generator 18F (manufactured by Heidolph Instruments GmbH & CO. KG) for emulsification, Benzophenone emulsion liquid 1 was obtained.

Obtained Benzophenone emulsion liquid 1 was put into a separable flask. While supplying nitrogen into the gas phase, Benzophenone emulsion liquid 1 was heated and stirred at 40° C. for 90 minutes to remove the organic solvent. Benzophenone particle dispersion liquid 1 was thereby obtained.

The mass average diameter of the benzophenone particles in Benzophenone particle dispersion liquid 1 was measured using the electrophoretic light scattering photometer "ELS-800" (manufactured by Otsuka Electronics Co., Ltd.) and was 145 nm.

(3) Preparation of Yellow Colorant Particle Dispersion Liquid Y-1

95 mass parts of sodium n-dodecyl sulfate were added to 1600 mass parts of ion-exchanged water. While stirring the solution, 250 mass parts of C.I. pigment yellow 74 was gradually added to the solution. Subsequently, by dispersion with a stirrer "CLEARMIX" (manufactured by M Technique Co., Ltd.), Yellow colorant particle dispersion liquid Y-1 was prepared.

The volume-based median diameter of the colorant particles in the Yellow colorant particle dispersion liquid Y-1 was 126 nm. In this example, the volume-based median diameter of the colorant particles was measured with "Microtrac UPA-150" (manufactured by Honeywell Japan, Inc.).

(4) Aggregation and Fusing

Into a reaction vessel equipped with a stirrer, a temperature sensor, and a cooling tube were put 504 mass parts (in solid fraction) of the above-prepared Styrene-acrylic resin Dispersion liquid 1, 98 mass parts (in solid fraction) of Benzophenone particle dispersion liquid 1, 900 mass parts of ion-exchanged water, and 52 mass parts (in solid fraction) of Yellow colorant particle dispersion liquid Y-1. While the inner temperature of the vessel was kept to be 30° C., a 5 mol/L sodium hydroxide aqueous solution was added in the vessel to adjust the pH to be 10.

Subsequently, an aqueous solution of 2 mass parts of magnesium chloride hexahydrate dissolved in 1,000 mass parts of ion-exchanged water was prepared. This aqueous solution was added to the liquid in the vessel over a period of 10 minutes while stirring. After addition of the aqueous solution, rising of the temperature of the system was started to 70° C. over a period of 60 minutes, and the temperature was held at 70° C. to allow the particle growth reaction to continue. While keeping this condition, the particle size of the aggregated particles was measured by using a "Multisizer 3" (manufactured by Beckman Coulter, Inc.). When the volume-based median particle size ($D_{50}$) reached 6.5 μm, an aqueous solution of 190 mass parts of sodium chloride dissolved in 760 mass parts of ion-exchanged water was added to terminate the particle growth. Then, the liquid in the vessel was further kept at 70° C. and stirred over one hour. Then, the temperature of the liquid in the vessel was further increased to 75° C. Subsequently, by stirring the liquid in the vessel while keeping the temperature at 75° C., fusion of the particles was allowed to proceed. Then, the liquid in the vessel was cooled to 30° C. Thus, a toner particle dispersion liquid was obtained.

The obtained toner particle dispersion liquid was subjected to a solid-liquid separation treatment with a centrifugal separator. Thus a wet cake of toner particles was formed. The wet cake was washed with ion-exchanged water at 35° C. using a centrifugal separator until the electric conductivity of the filtrate becomes 5 μS/cm. Then, the solid was transferred in "Flush Jet dryer" (made by Seishin Enterprise, Co. Ltd.), and it was dried until the content of water becomes 0.5 mass %. Thus, Toner particles 1 were obtained.

To the dried Toner particles 1 were added 1 mass % of hydrophobic silica (number average primary particle diameter=12 nm) and 0.3 mass % of hydrophobic titanium oxide (number average primary particle diameter=20 nm). The mixture was blended by using a Henschel mixer. Thus, a Toner 1 having a glass transition temperature (Tg) of 45° C., and a volume-based median diameter of 6.4 μm was obtained.

<Production of Toner 2>

Toner 2 was produced in the same way as production of Toner 1, except that, in the aggregation and fusing steps, the added amount of Styrene-acrylic resin Dispersion liquid 1 was changed to 307 mass parts and the added amount of Benzophenone particle dispersion liquid 1 was changed to 295 mass parts.

<Production of Toner 3>

Toner 3 was produced in the same way as production of Toner 1, except that, in the aggregation and fusing steps, the added amount of Styrene-acrylic resin Dispersion liquid 1 was changed to 601 mass parts of and the added amount of Benzophenone particle dispersion liquid 1 was changed to 1.3 mass parts.

<Production of Toner 4>

Toner 4 was produced in the same way as production of Toner 1, except that, in the aggregation and fusing steps, the added amount of Styrene-acrylic resin Dispersion liquid 1 was changed to 406 mass parts of and the added amount of Benzophenone particle dispersion liquid 1 was changed to 196 parts.

<Production of Toner 5>

Toner 5 was produced in the same way as production of Toner 1, except that, in the aggregation and fusing steps, the added amount of Styrene-acrylic resin Dispersion liquid 1 was changed to 582 mass parts of and the added amount of Benzophenone particle dispersion liquid 1 was changed to 20 mass parts.

<Production of Toner 6>

Toner 6 was produced in the same way as production of Toner 1, except that Benzotriazole particle dispersion liquid 1 prepared as described below was used instead of Benzophenone particle dispersion liquid 1

(Preparation of Benzotriazole Particle Dispersion Liquid 1)

80 mass parts of dichloromethane and 20 mass parts of benzotriazole (LA-29, manufactured by ADEKA Corp.) as a ultraviolet light absorber was mixed and stirred while beating at 50° C. to obtain a liquid including benzotriazole. To 100 mass parts of this liquid was added a mixed liquid of 99.5 mass parts of distilled water heated to 50° C. and 0.5 mass parts of 20 mass % sodium dodecylbenzenesulfonate aqueous solution. By stirring at 16000 rpm for 20 minutes using a homogenizer having a shaft generator 18F (manufactured by Heidolph Instruments GmbH & CO. KG) for emulsification, a Benzotriazole emulsion liquid 1 was obtained.

Obtained Benzotriazole emulsion liquid 1 was put into a separable flask. While supplying nitrogen into the gas phase, Benzotriazole emulsion liquid 1 was heated and stirred at 40° C. for 90 minutes to remove the organic solvent. Benzotriazole particle dispersion liquid 1 was thereby obtained.

The mass average diameter of the benzotriazole particles in Benzotriazole particle dispersion liquid 1 was measured using the electrophoretic light scattering photometer "ELS-800" (manufactured by Otsuka Electronics Co., Ltd.) and was 150 nm.

<Production of Toner 7>

Toner 7 was produced in the same way as production of Toner 1, except that Triazine particle dispersion liquid 1 prepared as described below was used instead of the Benzophenone particle dispersion liquid 1

(Preparation of Triazine Particle Dispersion Liquid 1)

80 mass parts of dichloromethane and 20 mass parts of triazine (LA-F70, manufactured by ADEKA Corp.) as a ultraviolet light absorber was mixed and stirred while heating at 50° C. to obtain a liquid including triazine. To 100 mass parts of this liquid was added a mixed liquid of 99.5 mass parts of distilled water heated to 50° C. and 0.5 mass parts of 20 mass % sodium dodecylbenzenesulfonate aqueous solution. By stirring at 16000 rpm for 20 minutes using a homogenizer having a shaft generator 18F (manufactured by Heidolph Instruments GmbH & CO. KG) for emulsification, Triazine emulsion liquid 1 was obtained.

Obtained Triazine emulsion liquid 1 was put into a separable flask. While supplying nitrogen into the gas phase, Triazine emulsion liquid 1 was heated and stirred at 40° C. for 90 minutes to remove the organic solvent. Triazine particle dispersion liquid 1 was thereby obtained.

The mass average diameter of the triazine particles in Triazine particle dispersion liquid 1 was measured using the electrophoretic light scattering photometer "ELS-800" (manufactured by Otsuka Electronics Co., Ltd.) and was 141 nm.

<Production of Toner 8>

Toner 8 was produced in the same way as production of Toner 1, except that Cyanoacrylate particle dispersion liquid 1 prepared as described below was used instead of Benzophenone particle dispersion liquid 1

(Preparation of Cyanoacrylate Particle Dispersion Liquid 1)

80 mass parts of dichloromethane and 20 mass parts of cyanoacrylate (Uvinul3035, manufactured by BASF Japan Co. Ltd.) as a ultraviolet light absorber was mixed and stirred while heating at 50° C. to obtain a liquid including cyanoacrylate. To 100 mass parts of this liquid was added a mixed liquid of 99.5 mass parts of distilled water heated to 50° C. and 0.5 mass parts of 20 mass % sodium dodecylbenzenesulfonate aqueous solution. By stirring at 16000 rpm for 20 minutes using a homogenizer having a shaft generator 18F (manufactured by Heidolph Instruments GmbH & CO. KG) for emulsification, Cyanoacrylate emulsion liquid 1 was obtained.

Obtained Cyanoacrylate emulsion liquid 1 was put into a separable flask. While supplying nitrogen into the gas phase, Cyanoacrylate emulsion liquid 1 was heated and stirred at 40° C. for 90 minutes to remove the organic solvent. Cyanoacrylate particle dispersion liquid 1 was thereby obtained.

The mass average diameter of the cyanoacrylate particles in Cyanoacrylate particle dispersion liquid 1 was measured using the electrophoretic light scattering photometer "ELS-800" (manufactured by Otsuka Electronics Co., Ltd.) and was 155 nm.

<Production of Toner 9>

Toner 9 was produced in the same way as production of Toner 1, except that Dibenzoylmethane particle dispersion liquid 1 prepared as described below was used instead of Benzophenone particle dispersion liquid 1

(Preparation of Dibenzoylmethane Particle Dispersion Liquid 1)

80 mass parts of dichloromethane and 20 mass parts of t-butyl methoxydibenzoylmethane (manufactured by Roche Diagnostics GmbH) as a ultraviolet light absorber was mixed and stirred while heating at 50° C. to obtain a liquid including dibenzoylmethane. To 100 mass parts of this liquid was added a liquid of 99.5 mass parts of distilled water heated to 50° C. and 0.5 mass parts of 20 mass % sodium dodecylbenzenesulfonate aqueous solution. By stirring at 16000 rpm for 20 minutes using a homogenizer having a shaft generator 18F (manufactured by Heidolph Instruments GmbH & CO. KG) for emulsification, Dibenzoylmethane emulsion liquid 1 was obtained.

Obtained Dibenzoylmethane emulsion liquid 1 was put into a separable flask. While supplying nitrogen into the gas phase, Dibenzoylmethane emulsion liquid 1 was heated and stirred at 40° C. for 90 minutes to remove the organic solvent. Dibenzoylmethane particle dispersion liquid 1 was thereby obtained.

The mass average diameter of the dibenzoylmethane particles in Dibenzoylmethane particle dispersion liquid 1 was measured using the electrophoretic light scattering photometer "ELS-800" (manufactured by Otsuka Electronics Co., Ltd.) and was 151 nm.

<Production of Toner 10>

Toner 10 was produced in the same way as production of Toner 1, except that, the added amount of Benzophenone particle dispersion liquid 1 was changed to 49 mass parts and 49 mass parts of Benzotriazole particle dispersion liquid 1 was added.

<Production of Toner 11>

Toner 11 was produced in the same way as production of Toner 1, except that Cyan colorant particle dispersion liquid Cy-1 prepared as described below was used instead of Yellow colorant particle dispersion liquid Y-1.

(Preparation of Cyan Colorant Particle Dispersion Liquid Cy-1)

90 mass parts of sodium n-dodecyl sulfate were added to 1600 mass parts of ion-exchanged water. While stirring the solution, 420 mass parts of Copper Phthalocyanine (C.I. Pigment Blue 15:3) was gradually added to the solution. Subsequently, by dispersion with a stirrer "CLEARMIX" (manufactured by M Technique Co., Ltd.), Cyan colorant particle dispersion liquid Cy-1 was prepared.

The volume-based median diameter of the colorant particles in the Cyan colorant particle dispersion liquid Cy-1 was 110 nm.

<Production of Toner 12>

Toner 12 was produced in the same way as production of Toner 1, except that Magenta colorant particle dispersion liquid M-1 prepared as described below was used instead of Yellow colorant particle dispersion liquid Y-1.

(Preparation of Magenta Colorant Particle Dispersion Liquid M-1)

95 mass parts of sodium n-dodecyl sulfite were added to 1600 mass parts of ion-exchanged water. While stirring the solution, 250 mass parts of C.I. Pigment Red 122 was gradually added to the solution. Subsequently, by dispersion with a stirrer "CLEARMIX" (manufactured by M Technique Co., Ltd.), Magenta colorant particle dispersion liquid M-1 was prepared.

The volume-based median diameter of the colorant particles in the Magenta colorant particle dispersion liquid M-1 was 115 nm.

<Production of Toner 13>

Toner 13 was produced in the same way as production of Toner 1, except that Black colorant particle dispersion liquid Bk-1 prepared as described below was used instead of Yellow colorant particle dispersion liquid Y-1.

(Preparation of Black Colorant Particle Dispersion Liquid Bk-1)

90 mass parts of sodium n-dodecyl sulfate were added to 1600 mass parts of ion-exchanged water. While stirring the solution, 320 mass parts of carbon black "Regal 330R" (manufactured by Cabot Corp.) was gradually added to the solution. Subsequently, by dispersion with a stirrer "CLEARMIX" (manufactured by M Technique Co., Ltd.), Black colorant particle dispersion liquid Bk-1 was prepared.

The volume-based median diameter of the colorant particles in the Black colorant particle dispersion liquid Bk-1 was 110 nm.

<Production of Toner 14>

Toner 14 was produced in the same way as production of Toner 1, except that, in the aggregation and fusing steps, Yellow colorant particle dispersion liquid Y-1 was not added and that the added amount of Styrene-acrylic resin dispersion liquid 1 was changed to 556 mass parts.

<Production of Toner 15>

Toner 15 was produced in the same way as production of Toner 1, except that, in the aggregation and fusing steps, Benzophenone particle dispersion liquid 1 was not added and that the added amount of Styrene-acrylic resin dispersion liquid 1 was changed to 602 mass parts.

<Production of Toner 16>

Toner 16 was produced in the same way as production of Toner 1, except that, in the aggregation and fusing steps, the added amount of Styrene-acrylic resin dispersion liquid 1 was changed to 602 mass parts and the added amount of Benzophenone particle dispersion liquid 1 was changed to 0.33 parts.

<Production of Toner 17>

Toner 17 was produced in the same way as production of Toner 1, except that, in the aggregation and fusing steps, the added amount of Styrene-acrylic resin dispersion liquid 1 was changed to 144 mass parts and the added amount of Benzophenone particle dispersion liquid 1 was changed to 458 parts.

<<Production of Developer>>

A ferrite carrier covered with a copolymer resin made of cyclohexyl methacrylate and methyl methacrylate (monomer mass ratio=1:1) and having a volume-based average particle diameter of 30 μm was mixed with Toners 1 to 17 produced as described above so that the content of the toner was 6 mass %. Thus, Developers 1 to 17 were prepared and used for the following evaluations. A V-type mixer was used as a mixer and the mixture was blended for 30 minutes.

<<Evaluation>>

Each of the produced toners (developers) was evaluated regarding fixing property and color reproducibility. The results are shown in TABLE I.

In Examples 19 to 21, two toners were used for evaluation.

<Fixing Property>

The test for fixing property was performed for the above-described Developers under the normal temperature and normal humidity environment (temperature 20° C. and humidity 50% RH). A pair of parallel plate (aluminum) electrodes was prepared in which a Developer was disposed on one of the electrodes and normal paper (basis weight: 64 $g/m^2$) was disposed on the other of the electrodes. Developer slid by magnetic force between the pair of electrodes. Under a condition in which the gap between the pair of electrodes was 0.5 mm and in which AC bias and DC bias were determined so that the toner coverage amount was 3 $g/m^2$, the toner was developed to form a toner layer on the surface of the paper. A print prepared by fixation by each fixing device was subjected to test for fixing property. An image of 1 cm square on this print was rubbed 10 times using "JK Wiper (registered trade mark)" (manufactured by Nippon Paper Crecia, Co, Ltd.) by giving a pressure of 10 kPa. The evaluation was made based on the fixing ratio of the image. A fixing ratio of 70% or more was regarded as acceptable.

The fixing ratio of the image is a value obtained by measuring the density of an image after printing and the density of the image after rubbing. The density was measured with a reflection densitometer "FD-7" (manufactured by SAKATA INX ENG. CO., LTD.). The fixing ratio is a value represented in percentage that is calculated from the reflection density of the solid image after rubbing divided by the reflection density of the solid image after printing.

As the fixing device was used the fixing unit 24 in the image forming apparatus in FIG. 1, with appropriate modification according to the various conditions shown in TABLE I as needed.

In Inventive examples 1 to 14 and 19 to 22 and Comparative examples 1 to 3, the maximum emission wavelength of the monochromatic light emitted from the light irradiating unit 91 was 365 nm (light source for the monochromatic light: LED light source having an emission wavelength within a wavelength range of 365 nm±20 nm) and the irradiation amount was 8 J/cm$^2$. In Inventive example 19, pressure was applied by a pressure applying unit after light irradiation.

In Inventive example 15, the maximum emission wavelength of the monochromatic light was 320 nm (light source for the monochromatic light: LED light source having an emission wavelength within a wavelength range of 320 nm±20 nm) and the irradiation amount was 8 J/cm$^2$.

In Inventive example 16, the maximum emission wavelength of the monochromatic light was 385 nm (light source for the monochromatic light: LED light source having an emission wavelength within a wavelength range of 385 nm±20 nm) and the irradiation amount was 8 J/cm$^2$.

In Inventive example 17, the maximum emission wavelength of the monochromatic light was 405 nm (light source for the monochromatic light: LED light source having an emission wavelength within a wavelength range of 405 nm±20 nm) and the irradiation amount was 8 J/cm$^2$.

In Inventive example 18, the maximum emission wavelength of the monochromatic light was 500 nm (light source for the monochromatic light: LED light source having an emission wavelength within a wavelength range of 500 nm±20 nm) and the irradiation amount was 8 J/cm$^2$.

In Comparative example 4, no monochromatic light was emitted.

In Comparative example 5, the maximum emission wavelength of the monochromatic light was 240 nm (light source for the monochromatic light: LED light source having an emission wavelength within a wavelength range of 240 nm±20 nm) and the irradiation amount was 8 J/cm$^2$.

In Comparative example 6, the maximum emission wavelength of the monochromatic light was 700 nm (light source for the monochromatic light: LED light source having an emission wavelength within a wavelength range of 700 nm±20 nm) and the irradiation amount was 8 J/cm$^2$.

<Color Reproducibility>

The color reproducibility of a monochromatic image or a multicolor image on copier paper was visually evaluated by ten monitors in accordance with the following evaluation standard. The evaluation was performed within a toner coverage amount range of 0.7±0.05 mg/cm$^2$.

A: Particularly excellent color reproducibility (Bright color(s) or enough transparency when a clear toner without colorant is used)

B: Excellent color reproducibility

C: There is some color contamination but no practical problem (A bit muddy color)

D: There is a problem with image quality due to large color contamination (The image seems to be ringed with blue or muddy blue. In the case of a magenta image, the image seems to be tinged with red or vermilion.)

TABLE I

| | Configuration of first toner | | | | Configuration of second toner | | | |
|---|---|---|---|---|---|---|---|---|
| | | UV absorber | | | | UV absorber | | |
| Example No. | Toner No. | Kind | Added amount [mass %] | Colorant | Toner No. | Kind | Added amount [mass %] | Colorant |
| Inventive example 1 | Toner 1 | Benzophenone | 15 | Yellow | — | — | — | — |
| Inventive example 2 | Toner 2 | Benzophenone | 45 | Yellow | — | — | — | — |
| Inventive example 3 | Toner 3 | Benzophenone | 0.2 | Yellow | — | — | — | — |
| Inventive example 4 | Toner 4 | Benzophenone | 30 | Yellow | — | — | — | — |
| Inventive example 5 | Toner 5 | Benzophenone | 3 | Yellow | — | — | — | — |
| Inventive example 6 | Toner 6 | Benzotriazole | 15 | Yellow | — | — | — | — |
| Inventive example 7 | Toner 7 | Triazine | 15 | Yellow | — | — | — | — |
| Inventive example 8 | Toner 8 | Cyanoacrylate | 15 | Yellow | — | — | — | — |
| Inventive example 9 | Toner 9 | Dibenzoylmethane | 15 | Yellow | — | — | — | — |
| Inventive example 10 | Toner 10 | Benzophenone | 7.5 | Yellow | — | — | — | — |
| | | Benzotriazole | 7.5 | | | | | |
| Inventive example 11 | Toner 11 | Benzophenone | 15 | Cian | — | — | — | — |
| Inventive example 12 | Toner 12 | Benzophenone | 15 | Magenta | — | — | — | — |
| Inventive example 13 | Toner 13 | Benzophenone | 15 | Black | — | — | — | — |
| Inventive example 14 | Toner 14 | Benzophenone | 15 | — | — | — | — | — |
| Inventive example 15 | Toner 1 | Benzophenone | 15 | Yellow | — | — | — | — |
| Inventive example 16 | Toner 1 | Benzophenone | 15 | Yellow | — | — | — | — |
| Inventive example 17 | Toner 1 | Benzophenone | 15 | Yellow | — | — | — | — |
| Inventive example 18 | Toner 1 | Benzophenone | 15 | Yellow | — | — | — | — |
| Inventive example 19 | Toner 1 | Benzophenone | 15 | Yellow | — | — | — | — |
| Inventive example 20 | Toner 1 | Benzophenone | 15 | Yellow | Toner 11 | Benzophenone | 15 | Cian |
| Inventive example 21 | Toner 1 | Benzophenone | 15 | Yellow | Toner 12 | Benzophenone | 15 | Magenta |
| Inventive example 22 | Toner 9 | Benzophenone | 15 | Cian | Toner 13 | Benzophenone | 15 | Magenta |
| Comparative example 1 | Toner 15 | — | — | Yellow | — | — | — | — |
| Comparative example 2 | Toner 16 | Benzophenone | 0.05 | Yellow | — | — | — | — |
| Comparative example 3 | Toner 17 | Benzophenone | 70 | Yellow | — | — | — | — |
| Comparative example 4 | Toner 1 | Benzophenone | 15 | Yellow | — | — | — | — |
| Comparative example 5 | Toner 1 | Benzophenone | 15 | Yellow | — | — | — | — |
| Comparative example 6 | Toner 1 | Benzophenone | 15 | Yellow | — | — | — | — |

TABLE I-continued

| Example No. | Maximum emission wavelength [nm] | Pressure application after light irradiation | Fixing property [%] | Color reproducibility |
|---|---|---|---|---|
| Inventive example 1 | 365 | Not applied | 89 | A |
| Inventive example 2 | 365 | Not applied | 85 | A |
| Inventive example 3 | 365 | Not applied | 79 | A |
| Inventive example 4 | 365 | Not applied | 87 | A |
| Inventive example 5 | 365 | Not applied | 82 | A |
| Inventive example 6 | 365 | Not applied | 87 | A |
| Inventive example 7 | 365 | Not applied | 88 | A |
| Inventive example 8 | 365 | Not applied | 85 | A |
| Inventive example 9 | 365 | Not applied | 90 | A |
| Inventive example 10 | 365 | Not applied | 88 | A |
| Inventive example 11 | 365 | Not applied | 88 | A |
| Inventive example 12 | 365 | Not applied | 89 | A |
| Inventive example 13 | 365 | Not applied | 91 | A |
| Inventive example 14 | 365 | Not applied | 86 | A |
| Inventive example 15 | 320 | Not applied | 86 | A |
| Inventive example 16 | 385 | Not applied | 87 | A |
| Inventive example 17 | 405 | Not applied | 86 | A |
| Inventive example 18 | 500 | Not applied | 76 | A |
| Inventive example 19 | 365 | applied | 93 | A |
| Inventive example 20 | 365 | Not applied | 88 | A |
| Inventive example 21 | 365 | Not applied | 87 | A |
| Inventive example 22 | 365 | Not applied | 90 | A |
| Comparative example 1 | 365 | Not applied | 55 | A |
| Comparative example 2 | 365 | Not applied | 62 | A |
| Comparative example 3 | 365 | Not applied | Not measurable (image peeling) | |
| Comparative example 4 | No irradiation | Not applied | Not measurable (offset) | |
| Comparative example 5 | 240 | Not applied | 88 | D |
| Comparative example 6 | 700 | Not applied | 30 | A |

SUMMARY

According to TABLE I, it is clearly recognized that Inventive examples 1 to 21 has excellent fixing property and color reproducibility compared to Comparative examples 1 to 6.

Accordingly, it could be confirmed that good fixing property and high color reproducibility is realized with an image forming method which uses a toner including toner particles including a binder resin and an ultraviolet light absorber, wherein the content of the ultraviolet light absorber is in the range of 0.1 to 50 mass % with respect to the total mass of the toner particles, and which includes: transferring a toner image formed with the toner on a recording medium; and irradiating the toner image transferred on the recording medium with monochromatic light having a maximum emission wavelength within the wavelength range of 280 to 550 nm to melt and fix the toner image.

Although embodiments of the present invention have been described and illustrated in detail, it is clearly understood that the same is by way of illustration and example only and not limitation, the scope of the present invention should be interpreted by terms of the appended claims.

The entire disclosure of Japanese Patent Application No. 2017-134687 filed on Jul. 10, 2017 is incorporated herein by reference in its entirety.

What is claimed is:

1. An image forming method using a toner including toner particles including a binder resin and an ultraviolet light absorber, wherein content of the ultraviolet light absorber is within a range of 0.1 to 50 mass % with respect to total mass of the toner particles, the method comprising:

transferring a toner image formed with the toner on a recording medium; and irradiating the toner image transferred on the recording medium with monochromatic light having a maximum emission wavelength within a wavelength range of 280 to 550 nm to melt and fix the toner image, wherein the ultraviolet light absorber includes at least one selected from the group consisting of a benzophenone ultraviolet light absorber, a benzotriazole ultraviolet light absorber, a triazine ultraviolet light absorber, a cyanoacrylate ultraviolet light absorber, and a dibenzoylmethane ultraviolet light absorber, and the ultraviolet light absorber has a molecular weight of equal to or less than 700.

2. The image forming method according to claim 1, wherein the toner includes a colorant.

3. The image forming method according to claim 1, wherein the toner includes a releasing agent.

4. The image forming method according to claim 1, wherein, in the transferring of the toner image, the toner image is transferred on the recording medium using only a black toner.

5. The image forming method according to claim 1, wherein, in the transferring of the toner image, the toner image is transferred on the recording medium using at least two toners having different colors from each other.

6. The image forming method according to claim 1, further comprising:

applying pressure to the toner image transferred on the recording medium.

7. The image forming method according to claim 6, wherein the applying of pressure to the toner image is performed after melting and fixing the toner image.

8. An image forming apparatus employing the image forming method according to claim 1, comprising:

a transfer unit to transfer a toner image formed using the toner on a recording medium; and a fixing unit to melt and fix the toner image by irradiating the toner image transferred on the recording medium with monochromatic light having a maximum emission wavelength within a wavelength range of 280 to 550 nm.

9. The image forming method according to claim 1, wherein the benzophenone ultraviolet light absorber is selected from the group consisting of octabenzone, 2,4-hydroxybenzophenone, 2-hydroxy-4-methoxybenzophenone, and 2-hydroxy-4-n-octyloxybenzophenone, the benzotriazole ultraviolet light absorber is selected from the group consisting of 2-(2p-cresol,2-(2H-benzotriazole-2-yl)-4,6-bis(1-methyl-1-phenylethyl)phenol, 2-[5-chloro(2H)-benzotriazole-2-yl]-4-methyl-6-(tert-butyl)phenol, 2-(2H-benzotriazole-2-yl)-4,6-di-tert-pentylphenol, 2-(2H-benzotriazole-2-yl)-4-(1,1,3,3-tetramethylbutyl)phenol, reaction products of methyl-3-[3-t-butyl-5-(2H-benzotriazole-2-yl)-4-hydroxyphenyl]propionate/polyethylenglycol (molecular weight: about 300), 2-(2H-benzotriazole-2-yl)-6-dodecyl-4-methylphenol, 2-(2-hydroxy-5-tert-butylphenyl)-2H-benzotriazole, 2-ethylhexyl-3-[3-tert-butyl-4-hydroxy-5-(5-chloro-2H-benzotriazole-2-yl)phenyl] propionate, 2-(2H-benzotriazole-2-yl)-4,6-bis(1-methyl-1-phenylethyl)phenol, and 2-(2H-benzotriazole-2-yl)-6-(1-methyl~1-phenylethyl)-4-(1,1,3,3-tetramethylbutyl)phenol, the triazine ultraviolet light absorber is selected from the group consisting of 2-(4,6-bis(2,4-dimethylphenyl)-1,3,5-triazin-2-yl)-5-hydroxyphenyl, 2-(4,6-diphenyl-1,3,5-triazin-2-yl)-5-(hexyloxy) phenol, 2-[4-[(2-hydroxy-3-dodecyloxypropyl)oxy]-2-hydroxyphenyl]-4,6-bis(2,4-dimethylphenyl)-1,3,5-triazine, 2-[4-[(2-hydroxy-3-(2'-ethyl)hexyl)oxy]-2-hydroxyphenyl]-4,6-bis(2,4-dimethylphenyl)-1,3,5-triazine, 2,4-bis(2-hydroxy-4-butyloxyphenyl)-6-(2,4-bis-butyloxyphenyl)-1,3,5-triazine, and 2-(2-hydroxy-4-[1-octyloxycarbonylothoxy]phenyl)-4,6-bis(4-phenyl)-1,3,5-triazine, the cyanoacrylate ultraviolet light absorber is selected from the group consisting of ethyl2-cyano-3,3-diphenylacrylate and 2'-ethylhexyl2-cyano-3,3-diphenylacrylate, and the dibenzoylmethane ultraviolet light absorber is 4-tert-butyl-4'-methoxydibenzoylmethane.

* * * * *